US005883475A

United States Patent [19]

Beasley

[11] Patent Number: 5,883,475

[45] Date of Patent: Mar. 16, 1999

[54] METHOD OF AVOIDING ACOUSTIC COMPRESSION WAVE RESONANCE IN HIGH FREQUENCY, HIGH INTENSITY DISCHARGE LAMPS

[75] Inventor: Denny D. Beasley, Cincinnati, Ohio

[73] Assignee: Delta Power Supply, Inc., Cincinnati, Ohio

[21] Appl. No.: 877,769

[22] Filed: Jun. 17, 1997

Related U.S. Application Data

[60] Provisional application No. 60/019,887 Jun. 17, 1996.

[51] Int. Cl.[6] ..... H01J 61/82

[52] U.S. Cl. ..... 315/307; 315/246

[58] Field of Search ..... 315/246, 307

[56] References Cited

U.S. PATENT DOCUMENTS 4,170,746 10/1979 Davenport ..... 315/246

5,623,187 4/1997 Caldeira et al. ..... 315/307

*Primary Examiner*—Robert Pascal

*Assistant Examiner*—Justin P. Bettendorf

*Attorney, Agent, or Firm*—Porter, Wright, Morris & Arthur

[57] ABSTRACT

The present invention utilizes the natural damping of acoustic compression waves within an gas discharge tube, typically a high intensity discharge ("HID") lamp, to avoid resonant acoustic waves having sufficient amplitude to affect adversely the performance or lifetime of the HID lamp. The energy delivered to the HID lamp during each half-cycle of driving power is measured and adjusted such that the total time-averaged power delivered to the lamp remains constant at the lamp's rated power level, but the energy delivered to the discharge gas during each half-cycle is maintained below that level of half-cycle energy delivery at which acoustic resonance will overcome damping and build to harmful levels of amplitude. This is accomplished according to the present invention by varying the frequency of the applied electrical power. For a constant time-averaged power delivered to the lamp, increasing the frequency necessarily entails a reduction in the energy delivered per cycle. The present invention relates to maintaining constant power in a HID lamp yet avoiding acoustic resonance by dynamic adjustment of the frequency and power per cycle such that the acoustic wave amplitudes, determined by the power per cycle, is held to a level at which the natural damping mechanisms of the tube will suppress resonance.

7 Claims, 1 Drawing Sheet

METHOD OF AVOIDING ACOUSTIC COMPRESSION WAVE RESONANCE IN HIGH FREQUENCY, HIGH INTENSITY DISCHARGE LAMPS

RELATED APPLICATIONS

This application is based upon provisional application serial number 60/019,887, filed on Jun. 17, 1996 pursuant to 35 U. S. C. § 111 (b), having the same title and inventor as the present application, and claims right of priority therefrom pursuant to 35 U. S. C. § 119(e).

FIELD OF INVENTION

This invention relates to the general field of high intensity discharge ("HID") lamps operated by means of high frequency applied power. More particularly, the present invention relates to methods for avoiding the generation of resonant acoustic compression waves during the high frequency operation of HID lamps.

BACKGROUND OF INVENTION

High intensity discharge lamps such as sodium, metal halide, mercury and others are commonly used sources of illumination due to their relatively high efficiencies in converting electrical input power into light output, and also due to their relatively long service lifetimes. It is well known that the efficiency of HID lamps is generally improved by operating such lamps by means of high frequency electrical input power to drive the discharge within the lamp. However, high frequency operation of such lamps brings certain associated problems, including the generation of acoustic compression waves in resonance with the natural acoustic frequencies of the HID lamp.

The use of alternating current to power an HID lamp necessarily involves a non-constant, time-varying application of electrical power to the electrodes of the HID lamp. This time-varying application of electrical power generates concomitant variations in the gas through which the electrical discharge occurs. For example, negative voltage applied to a discharge electrode will repel electrons from the vicinity thereof. Alternation of the polarity of the applied voltage during the next half-cycle will attract electrons to the same electrode. This alternative attraction and repulsion of electrons (and corresponding repulsion and attraction of positive ions) from a discharge electrode causes pressure variations in the gas in the vicinity of this electrode, substantially at double the frequency of the applied voltage, since both positive and negative applied voltages generate local regions of compression. Such pressure variations created in the vicinity of a discharge electrode will typically propagate into the gas of the HID lamp as an "acoustic wave" or an "acoustic compression wave". Thus, these acoustic waves are an inherent and unavoidable consequence of driving the electrical discharge by means of alternating positive and negative voltage being applied to the discharge electrodes. Methods for controlling these acoustic waves to avoid harmful effects on the HID lamp are the subject of the present invention.

When the discharge-induced acoustic compression waves occur at the natural acoustic frequencies of the HID lamp, acoustic resonance occurs. The phenomena of acoustic resonance essentially generates standing pressure waves within the HID tube. Such waves can cause the light from the lamp to flicker; cause the arc within the tube to warp, bend or become extinguished; or in extreme cases cause the arc to contact the walls of the HID lamp and damage or destroy the tube itself. Even modest variations in spacial or temporal light intensity are unacceptable in many applications of HID lamps in which focusing of the light is necessary. Other deleterious effects of acoustic resonance may considerably shorten the service lifetime of the lamp.

The precise frequencies at which acoustic resonance occurs is a complex function of the composition, temperature and pressure of the gas within the HID tube, and the geometry of the tube itself. In addition, the composition, temperature and pressure of the gas varies from place to place within the tube, being typically hotter and less dense near the center of the arc while cooler and more dense near the walls of the tube. Adding further to the complexity of acoustic resonance is the fact that the properties of the tube and the gas are not constant over time. Tube electrodes will typically change their geometry over the lifetime of the lamp as they are subjected to numerous hours of electrical discharge and bombardment by ions, electrons and neutral species from the gas of the HID tube. The composition of the gas will similarly change over time as chemical processes within the HID gas proceed over many hours of operation. Practical manufacturing tolerances also lead to variations in tube geometry from lamp to lamp, even when new. All these factors accumulate so as to make it exceedingly difficult to predict with any reasonable precision the acoustic resonance frequencies of a particular HID tube, or to predict how such acoustic resonance frequencies will change over the service lifetime of the lamp. In general, acoustic resonance frequencies tend to occur in the range above about 10 KHz for typical HID lamps, increasing thereby the complexity in obtaining efficient, high frequency operation of such lamps.

Despite the difficulties in predicting acoustic resonance effects, several attempts have been made to avoid acoustic resonance and the accompanying deleterious effects on the operation of the HID lamp.

The work of Wada et. al. (U.S. Pat. No. 4,724,361) involves a careful exploration of the frequency regions at which acoustic resonance occurs for various tube geometries. These inventors suggest the use of certain HID tube geometries, with special attention to the design in the region of the tube end caps, so as to minimize the frequency range in which resonance occurs. Such designs presumably make it easier to avoid the remaining acoustic resonant frequencies in the operation of the HID lamp.

Davenport (U.S. Pat. No. 4,170,746) has carefully evaluated the frequency ranges at which acoustic resonance occurs for the special case of miniature high pressure metal vapor lamps (typically less than 1 cubic centimeter in discharge volume). Davenport finds resonance-free regions between approximately 20 KHz and 50 KHz for such lamps and suggests operation at these frequencies as a solution for acoustic resonance, at least for the miniature lamps included in his studies.

An approach to avoiding acoustic resonance by choosing a suitable geometry for the HID tube has certain serious drawbacks. In typical operation, square wave pulses have often been used to drive the HID discharge. Such pulses contain numerous harmonic components, increasing markedly the chance that one or more of such frequencies will occur at an acoustic resonance with the tube. Also, as noted above, the tube geometry and acoustic propagation properties are not constant over the service lifetime of the tube. Successful avoidance of acoustic resonance at one time may not necessarily lead to avoidance of acoustic resonance at a later time during the service life of the tube.

For these reasons, other workers in the field have looked to avoid acoustic resonance by means other than careful selection of the geometry of the tube, and/or careful selection of driving frequencies. For example, in the work of Bonazoli et. el. (U.S. Pat. No. 4,373,146), a square-wave driving pulse is frequency modulated to sweep the applied frequency from about 20 to 30 KHz. The idea here is to avoid the detrimental effects of acoustic resonances by sweeping the driving power quickly through any acoustic resonance frequency which may occur in the spectrum of the driving power of the lamp. The result is presumably that acoustic resonance waves do not build up to large amplitudes since power is delivered to the tube at any one resonant frequency for only brief periods of time. However, the use of square waves (although modulated) necessarily provides a reasonably broad spectrum of frequencies at which input power is delivered to the tube, thus potentially exciting many acoustic resonances within the HID tube. Sweeping or modulating a square wave, or sawtooth, or other waveform, will not readily avoid the generation of a rich spectrum of acoustic frequencies within the HID discharge gas.

Kachmarik et. al. (U.S. Pat. No. 5,357,173) use a square wave pulse with carefully selected pulse widths. Their intent seems to be to tailor the pulse harmonics such that low amplitudes (readily damped within the HID tube) occur at the acoustic resonant frequencies of the particular HID tube.

All of the above approaches to dealing with acoustic resonance in HID tubes depend upon some previous knowledge of the acoustic resonant frequencies to be encountered, allowing either the tube geometry, the driving power waveform, or perhaps both, to be adjusted to reduce or avoid those problems brought by uncontrolled acoustic resonance. We mention above that such approaches are problematic in so far as the acoustic resonance frequencies of any particular HID tube are not generally expected to remain constant over the service lifetime of the tube, or from tube to tube. Even successful avoidance of acoustic resonance in new tubes may prove ineffective after some hours of use. Tube to tube variations are also inherent in any practical manufacturing process, leading to different acoustic resonant frequencies for different samples of the same lamp. Thus, acoustic resonance phenomena appear as yet another factor tending to degrade the performance and reduce the useful service lifetime of such HID tubes.

Another approach to dealing with acoustic resonance has been to look for beneficial effects of such resonance, and design HID tubes intentionally to generate acoustic resonance to utilize such beneficial effects. The work of Roberts (U.S. Pat. No. 4,983,889) uses standing waves generated by acoustic resonance as a means to achieve mixing of components in a multi-component HID tube. The work of Dakin et. al. (U.S. Pat. No. 5,306,987) uses intentionally generated acoustic resonance waves within an HID tube (in conjunction with a suitably modulated driving waveform), to achieve stability of the arc. However, as noted above, it is not simple to maintain stability in acoustic resonance (either avoiding it or generating it intentionally) due to the varying resonant frequencies occurring over the service lifetime of the HID lamp as well as lamp to lamp variations.

In contrast to much of the prior art, the present invention is not based upon avoidance of the acoustic resonant frequencies of the particular HID lamp. Rather, the present invention makes use of the natural damping mechanisms of the HID tube. Acoustic compression waves will be subject to two general classes of damping within the HID tube. One mechanism of damping is "viscous damping" in which the intermolecular, interatomic and interionic forces between the electrons, atoms, ions and molecules within the tube lead to a finite viscosity in the discharge gas. Propagation of an acoustic compression wave through such a viscous medium will be subject to damping due to the energy extracted from the wave in moving one species against another.

The second general class of damping results from the impact of the acoustic compression wave with the wall of the tube, as well as with other structures (electrodes, end caps, etc.) within the tube. For economy of language, we will refer to all such solid surfaces onto which an acoustic wave might impinge as "walls". Transfer of energy from the acoustic wave to the tube wall results in loss of energy from the wave and, hence, damping. Typically, such "wall effect" damping will dominate viscous damping under conditions of pressure, temperature, composition and geometrical configuration typically found in HID tubes.

SUMMARY OF INVENTION

The present invention makes use of the natural damping mechanisms within the tube, in conjunction with a careful selection, metering, and adjustment of the conditions of energy input to the tube, in order to avoid the undesirable consequences of acoustic resonance. It is found by the present invention that mechanisms of acoustic wave damping are not overly sensitive to slight variations in manufacturing tolerances from tube to tube, nor to variations within the same tube as it ages. In conjunction with controlled input of electrical power to drive the tube, the present invention uses the natural damping mechanisms of the gas within the tube to avoid acoustic resonances throughout the useful lifetime of a particular tube, essentially impervious to changes therein from tube to tube or during the tube's service life.

The present invention utilizes the natural damping of acoustic compression waves within an HID tube in order to avoid the generation of resonant acoustic waves having sufficient amplitude to affect adversely the performance or lifetime of the HID lamp. One method of practicing the present invention for avoiding acoustic resonance includes driving the HID lamp with filtered sinusoidal electrical power, eliminating thereby the generation of significant acoustic compression waves at frequencies corresponding to numerous harmonic components associated with other waveforms of delivered driving power. The energy delivered to the HID lamp during each half-cycle of driving power is measured and adjusted such that the total time-averaged power delivered to the lamp remains constant at the lamp's rated power level, but the energy delivered to the discharge gas during each half-cycle is maintained below that level of half-cycle energy delivery at which acoustic resonance will overcome damping and build to harmful levels of amplitude. In an embodiment of the present invention, this is accomplished by varying the frequency of the applied electrical power. For a constant power delivered to the lamp, increasing the frequency (increasing the number of cycles per second) necessarily entails a reduction in the energy delivered per cycle since power (held constant in the present invention at the rated power of the lamp) =energy delivered per second =(energy delivered per cycle) * (cycles per second, or frequency). Thus, the present invention relates to maintaining constant power in the lamp yet avoiding acoustic resonance by dynamic adjustment of the frequency and power per cycle such that the acoustic wave amplitudes, determined by the power per cycle, is held to a level at which the natural damping mechanisms of the tube will suppress resonance.

OBJECTS OF THE INVENTION

A primary object of the present invention is to operate HID lamps without the development of significant amplitude of resonant acoustic waves within the lamp.

Another object of the present invention is to operate HID lamps wherein the energy. delivered to the discharge gas at each half-cycle of energy delivery is maintained below a predetermined limit.

Another object of the present invention is to operate HID lamps wherein the energy delivered to the discharge gas at each half-cycle of energy delivery is maintained below a predetermined limit while maintaining at a constant value the time averaged power delivered to the lamp.

Yet another object of the present invention is to operate HID lamps with filtered sinusoidal electrical driving power, reducing thereby energy delivered to acoustic compression waves corresponding to harmonics other than the sinusoidal driving frequency.

Another object of the present invention is to adjust the frequency of the driving electrical power in order to maintain time averaged power constant at substantially the rated power level of the lamp, and energy per half-cycle below a predetermined value.

DESCRIPTION OF PREFERRED EMBODIMENTS

Figure 1A:
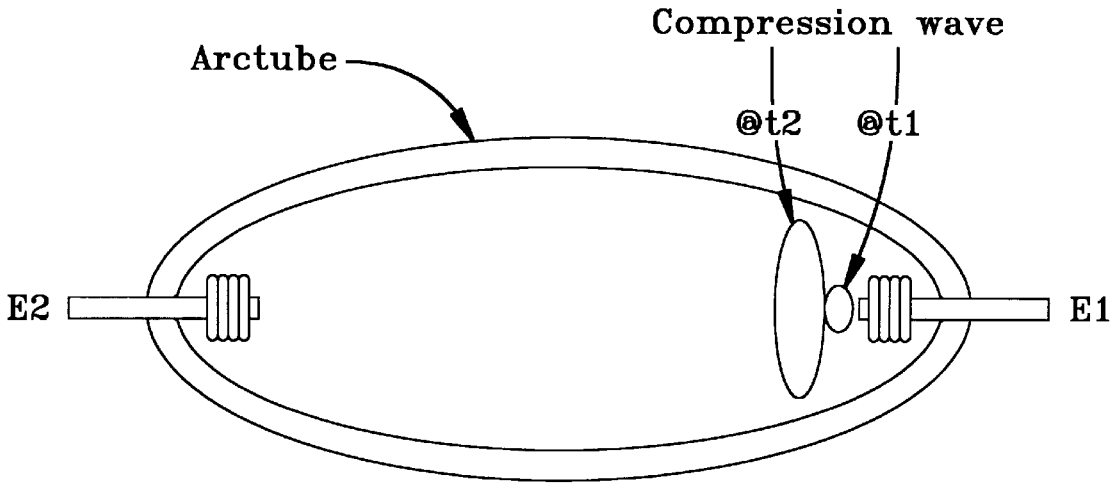
FIG. 1*a*: Schematic depiction of arc tube with acoustic compression waves.

The present invention makes use of the natural damping mechanisms within the tube, in conjunction with a careful selection, metering, and adjustment of the conditions of energy input to the tube, in order to avoid the undesirable consequences of acoustic resonance. It is found by the present invention that the natural damping mechanisms of acoustic waves within the typical HID tube are not overly sensitive functions of the precise conditions occurring within the particular HID tube. While the overall tube geometry, nature and composition of the gas, and operating conditions of the tube will have an effect on damping, the acoustic wave damping is found not to be very sensitive to slight variations in manufacturing tolerances from tube to tube, nor to variations within the same tube as it ages. This is in marked contrast to the above prior art in which the acoustic resonant frequencies (standing waves) are very sensitive functions of detailed tube geometry and gas condition, and to small variations therein. In conjunction with controlled input of electrical power to drive the tube, as discussed in detail below, the present invention uses the natural damping to avoid acoustic resonances throughout the useful lifetime of a particular tube, essentially impervious to changes therein from tube to tube or during the tube's service life.

The present invention utilizes the natural damping of acoustic compression waves within an HID tube in order to avoid the generation of resonant acoustic waves having sufficient amplitude to affect adversely the performance or lifetime of the HID lamp. The method of the present invention for avoiding acoustic resonance includes driving the HID lamp with filtered sinusoidal electrical power, eliminating thereby the generation of significant acoustic compression waves at frequencies corresponding to numerous harmonic components of the driving power. The energy delivered to the HID lamp during each half-cycle of driving power is also monitored according to the method of the present invention. The present invention recognizes that an important parameter in determining the amplitude of acoustic compression waves is the energy delivered into the HID lamp during each half-cycle of driving power. For a given rated total lamp power, the frequency of the filtered sinusoidal driving power is adjusted such that the total time-averaged power delivered to the lamp remains constant at the lamp's rated power level, but the energy delivered to the discharge gas during each half-cycle is maintained below that level of half-cycle energy delivery at which acoustic resonance will overcome damping and build to harmful levels of amplitude.

As noted above, the application of time varying electrical power to an electrode immersed in a gaseous environment, especially an environment in which gas discharge occurs, will inherently generate acoustic compression waves in such gas. This generation of acoustic compression waves is a natural consequence of gaseous species being alternatively attracted and repelled from the electrode as the electrical polarity of the electrode reverses during each half-cycle. The generation of compression waves is most noticeable for gases in which free electrons and ions are present (typically a discharge) since such charged species are more easily attracted or repelled in the presence of applied electric fields, as such fields will occur in the vicinity of the electrode. However, acoustic compression waves will also be generated in neutral gases for the common case in which the applied electric field is not constant in space. Thus, a pointed or curved electrode will create an electric field in its vicinity more intense closer to the electrode than further removed. Polar gaseous species, possessing separated regions of positive and negative charge, will tend to orient and drift towards the electrode as the attraction of one charged portion of the gaseous species will tend to exceed the repulsion of the oppositely charged region of said species by the nonuniform electric field. Even nonpolar gaseous species, lacking permanent separation of charges, will nevertheless polarize under the influence of an applied electric field, creating thereby separated regions of positive Land negative charges. Under the influence of a spatially nonuniform electric field, such nonpolar but polarizable species will tend to orient and drift in much the manner of polar gaseous species. However, in practice it is typically the case that the compression waves generated by neutral species (whether polar or not) will have significantly lower amplitudes than the acoustic waves generated in ionized gases, such as occurring in a discharge. Therefore, the amplitudes of acoustic compression waves in neutral gases will be much less than in ionized gases for equivalent electric fields, and thus less likely to build up harmful amplitudes in resonant acoustic waves. For this reason we will direct our description of the present invention to ionized gases and discharges with the expectation that such gases will provide the primary motivation for avoiding the harmful effects of acoustic wave resonances. However, as is clear from the discussion below, the present invention for avoiding the harmful effects of acoustic resonance is in no way limited to ionized gases or discharges. Any gaseous species in which acoustic resonance is to be avoided or suppressed may make use of the methods of the present invention. Therefore, the present invention is explicitly intended to include any species in which acoustic resonance is encountered, not limited to high intensity discharge lamps, or to any particular form of electric discharge.

Figure 1B:
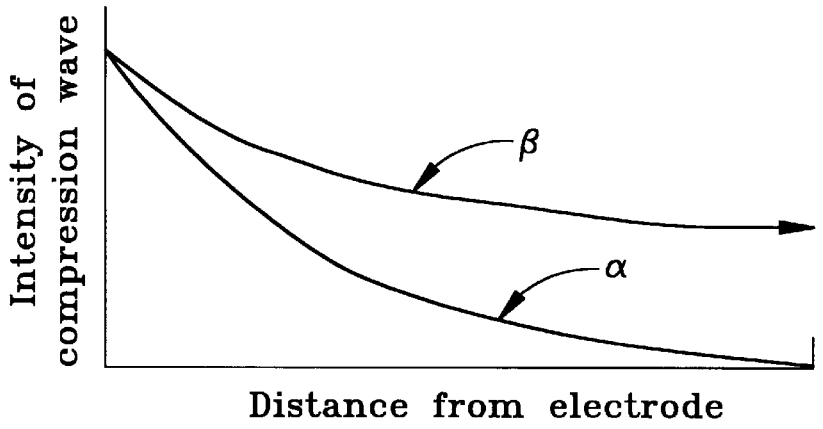
FIG. 1*b*: Damping of compression wave as function of distance from electrode. α depicts the behavior of a highly damped wave of the present invention. β depicts conventional damping.

FIG. 1(*a*) depicts schematically a container labeled "arc-tube" containing gas and two electrodes, E1, E2 to which alternating voltage is applied. This application of alternating voltage to the electrodes will typically generate acoustic compression waves propagating away from the electrodes. Two such acoustic compression waves are depicted schematically propagating away from the electrode E1 towards electrode E2 in FIG. 1(*a*). Although FIG. 1(*a*) is a depiction of the instantaneous condition of the tube, the wave generated at time t2 is denoted as "@t2" while the wave generate at a later time, t1 is depicted "@t1." For a symmetrical tube as depicted in FIG. 1(*a*), there will be symmetrical waves generated and propagating away from electrode E2 towards E1, not shown in FIG. 1(*a*).

FIG. 1(*b*) depicts the cycle-averaged intensity of acoustic compression waves for the damped case of the present invention, α, and the typical operation of such discharges, β. The β damping of FIG. 1(*b*) is insufficient to prevent a substantial portion of the intensity of the acoustic compression wave generated at one electrode from propagating the entire dimension of the tube. Thus, the conditions for positive reinforcement of waves exist and, at the appropriate resonant frequencies, acoustic resonance may occur. In contrast, the present invention maintains the intensity of acoustic compression waves such that damping occurs, as qualitatively depicted by a in FIG. 1(*b*). That is, the intensity of acoustic compression waves is maintained at sufficiently low levels that insignificant intensity propagates throughout the tube. Thus, insignificant reflection from walls or other tube structures occurs, and no opportunity exists for positive reinforcement. Thus, unlike the prior art, the present invention does not need to avoid resonant frequencies of the tube, but rather maintains sufficiently low intensity in each cycle of the acoustic waves that damping prevents the generation of resonant acoustic waves having deleterious intensity.

Much of the prior art related to acoustic resonance in gas discharges drives the discharge by means of square-wave, sawtooth, or other highly non-harmonic driving power waveforms. The harmonic analysis of such waveforms will naturally and inherently contain numerous harmonic components. In general, many of these component harmonic waveforms will create acoustic compression waves in resonance with several of the natural acoustic frequencies of the tube. It greatly complicates the task of avoiding acoustic resonance under such conditions when, simultaneously, numerous resonant acoustic waves are excited within the discharge gas. Therefore, one important feature of the present invention is to drive the gas discharge with a single sinusoidal waveform. By driving a typical HID discharge by means of a single (typically filtered) sinusoidal power input function, the excitation of acoustic compression waves at more than one frequency is greatly reduced. This simplifies the task of avoiding damaging acoustic resonance since only a single acoustic frequency is significant enough to warrant consideration in most cases. This simplification to a single frequency is in contrast to the prior art in which numerous acoustic frequencies are typically excited by non-harmonic driving power waveforms, creating potentially harmful resonances at numerous frequencies which must be dealt with simultaneously in avoiding acoustic resonance.

The preferred mode of practicing the present invention is to drive the gas discharge at a single frequency with filtered sinusoidal input power. However, it will be described below that another important feature of the present invention is the utilization of natural damping mechanisms occurring within the gas discharge tube to avoid harmful amplitudes of acoustic waves. For certain cases, the damping of acoustic waves may be sufficiently large at numerous frequencies that more than one sinusoidal input power waveform can be tolerated. Thus, for such cases, it may prove feasible to drive the discharge with a waveform other than filter sinusoidal. While filtered sinusoidal driving power is a very helpful feature in simplifying the suppression of acoustic resonance in the practice of the present invention, it will not always be necessary in avoiding the harmful effects of acoustic resonance for those cases in which acoustic damping is adequate at all component harmonic frequencies generated by a non-sinusoidal driving waveform.

The present invention recognizes that an important parameter in the generation of acoustic waves is the energy deposited into the gaseous species for each cycle or, equivalently, for each halfcycle. Local regions of compression are generated at each half-cycle of applied voltage. The amplitude of the acoustic compression will generally be a monotonically increasing function of the applied voltage. That is, a higher applied voltage will lead to higher electric fields in the vicinity of the electrode, leading in turn to a larger amplitude of the acoustic compression wave thereby generated. The amplitude of the compression wave is not generally expected to be related in any simple way to the magnitude of the applied voltage. The electrical characteristics of a typical gas discharge will be a complex function of the applied voltage. However, it will generally be the case that a larger applied voltage will lead to a larger amplitude for the acoustic compression wave generated therefrom. The present invention makes use of this effect in designing a method for avoiding the harmful effects of acoustic resonance in gas discharges, especially in high intensity discharge lamps.

Also as noted above, there are inherent damping mechanisms present for acoustic waves in every discharge tube. These tend to be predominantly wall effect damping mechanisms, but the precise damping mode is not essential for an understanding or practice of the present invention. The present invention consists of several steps for insuring that the damping of acoustic resonance waves is utilized to maintain the amplitudes of such resonance waves below those levels of intensity for which deleterious effects on the performance or lifetime of the lamp are typically expected to occur.

It is important to recognize that a key parameter in the generation of acoustic waves in a tube is the energy deposited into the gas at each half-cycle of the applied power. Therefore, an important feature of the present invention is to monitor and to control the energy delivered to the tube for each half-cycle. By keeping the energy per half-cycle sufficiently low, it is possible to operate a typical lamp under conditions at which damping dominates and suppresses the development of standing acoustic waves within the discharge tube, preventing thereby the development of harmful acoustic resonance phenomena. Controlling the energy per half-cycle is accomplished according to the present invention by controlling the frequency of the applied electrical power while maintaining constant average power delivered to the lamp. For example, a 500 watt lamp requires 500 joules of electrical power per second. Operating at 10 KHz results in 0.05 joules per cycle (0.025 per halfcycle) of electrical energy being deposited into the discharge gas and, therefore, available for the creation of acoustic resonance waves. If 0.025 joules per half-cycle is sufficiently large such as to create bothersome acoustic resonances (one procedure for determining "sufficiently large" is described below), operating at 15 KHz results in 0.017 joules per half-cycle being deposited into the discharge gas, yet maintains lamp power at 500 watts. Thus, control of the frequency of applied power is a convenient way to control the energy per half-cycle deposited into the discharge gas and is a central feature of the present invention.

We note in passing that variation of the frequency of the applied power waveform will introduce certain additional harmonic components, other than the nominal driving frequency, as the driving frequency is shifted from one value to another. Requiring the performance of such frequency shifts abruptly or often may negate much of the advantage brought by driving the discharge by means of filtered, essentially single frequency, sinusoidal power. However, in the practice of the present invention, such frequency shifts are not typically abrupt and not needed very often during the service lifetime of the lamp. While changing frequencies introduces certain additional harmonic components into the driving power waveform, such components are typically negligible and of very short duration, as the present invention would find application for HID lamps. If, however, instances arise in which frequency shifts are common or abrupt or both, it would then be necessary to allow sufficient margin of safety in the damping parameters (as described below) to accommodate and suppress acoustic resonances which might otherwise develop in association with harmonic components of driving power arising from such frequency shifting. The description of the method of the present invention contained herein permits easy generalization to accommodate this increased damping.

The first step in the practice of the present invention is typically to ascertain the level of damping present in the lamp. The common situation would be one in which the designer of the lamp driving circuit would want to design a single circuit to drive lamps having the same general characteristics and power levels, but different geometrical configurations. For this instance, it is necessary to determine which of the lamp configurations under consideration leads to the least damping of acoustic waves. That is, the first step is to determine which member of the class of lamps to be studied is likely to have the worst problems with acoustic resonance. Routine experimentation for various lamp configurations, geometries, power and frequency levels is typically done in order to make this determination. It is generally understood in the field that if the discharge of an HID lamp changes shape slightly as the spatial orientation of the tube is varied, this provides strong evidence that the tube is operating away from conditions of acoustic resonance; acoustic resonance tending to "lock" the discharge into a fixed region of space, relatively impervious to orientation and gravitation effects on the appearance of the discharge. This is one simple test by which the absence of acoustic resonance can be determined. For most cases, it is typically found that the spherical configuration of lamp (whenever the class of lamps to be studied includes a spherical member) will most likely be found to have the least damping of acoustic compression waves. This result is in accord with expectations as the spherical configuration encompasses the maximum volume of gas with the minimum wall area, hence providing the minimum surface area for wall effect damping. However, it is fairly straight forward to test each lamp geometrical configuration at a set of driving frequencies to see which lamp permits the onset of acoustic resonance at the lowest value of energy per half-cycle. As a safety factor, this lamp is used for detailed studies. In the event only a single type and geometry of lamp is to be driven, then there is no need for a "worst case" study of various geometries.

Thus, the first step in the practice of the present invention is to study various geometries of lamp, at various power input levels, and at various power input frequencies, to determine that lamp geometry, frequency, and energy input level (per half-cycle) at which acoustic resonance is most likely to create problems in the operation of the lamp. As noted, this will typically prove to be the spherical configuration. Then, this worst-case lamp of the class is investigated in further detail in order to ascertain the minimum energy input per half-cycle at which acoustic resonance is likely to begin for the operating frequency of interest. A range of operating frequencies around this central frequency is investigated, typically a range of plus or minus approximately 10%. These ranges are generally chosen so as to encompass the frequency ranges which are anticipated to be employed in the suppression of acoustic resonance by means of frequency shifting, in accordance with the practice of the present invention. Having ascertained a worst-case frequency level, the minimum energy per half-cycle at which acoustic resonance arises is determined. To ensure an adequate margin of safety, the frequency of input power is adjusted so the energy per half-cycle is less than about 85% of that at which the onset of acoustic resonance is observed. It may be necessary to iterated in frequency and energy per half-cycle to ascertain the range of frequency to be encountered and, simultaneously, the energy values per half-cycle at which avoidance of acoustic resonance can be assured. Thus, a range of operating conditions in frequency and energy per half-cycle is mapped out by experimentation.

Therefore, the practice of the present invention involves driving the HID lamp at the nominal design frequency (typically by means of filtered sinusoidal driving power) and measuring the power input to the lamp. Dividing the power input to the lamp (in watts) by twice the driving frequency (in Hz) gives the energy (in joules) delivered to the discharge gas per half-cycle. If acoustic resonance effects begin to occur, the power delivered to the lamp will tend to increase as standing waves begin to be established in the tube. The present invention measures such input power and adjusts the frequency of the driving power so as to maintain the energy per half-cycle below the critical level as determined by prior experimentation. A voltage controlled oscillator or similar circuitry well known in the field would typically be used to adjust the frequency of the applied power. Thus, acoustic resonance is continually avoided in the practice of the present invention by providing a suitable adjustment of the frequency of the driving power. The total power delivered to the lamp (i.e. the rated lamp power) is similarly maintained at a constant value by control circuitry and devices standard in the field.

Having described the invention in detail, those skilled in the art will appreciate that, given the present disclosure, modifications may be made to the invention without departing from the spirit of the inventive concept described herein. Therefore, it is not intended that the scope of the invention be limited to the specific and preferred embodiments illustrated and described. Rather, it is intended that the scope of the invention be determined by the appended claims.

I claim:

1. A method of avoiding acoustic compression wave resonance in a gas enclosed in a container having time-varying voltage applied to said enclosed gas comprising the steps of:

a) measuring the electrical energy delivered to said enclosed gas during each half-cycle; and b) reducing said electrical energy delivered during each half-cycle when said electrical energy exceeds a predetermined value, wherein said predetermined value of energy delivered during each half-cycle is a value sufficiently low such that damping of acoustic waves within said gas suppresses resonant acoustic compression waves; and c) increasing the frequency of the electrical energy delivered whenever the energy delivered during each halfcycle is reduced such that the total average power delivered to said enclosed gas remains substantially constant.

2. A method as in claim 1 wherein said electrical energy is delivered by means of an applied voltage having a substantially sinusoidal waveform.

3. A method as in claim 1 wherein said electrical energy is delivered at high frequency.

4. A method as in claim 1 wherein a high intensity discharge lamp comprises said gas enclosed in said container.

5. A method as in claim 4 wherein said predetermined value of energy delivered during each half-cycle is less than about 85% of the value of delivered energy at which acoustic resonance occurs.

6. A method as in claim 4 wherein said predetermined value of energy delivered during each half-cycle is determined for a family of lamps having different geometries by means of a single geometry chosen from the family of lamps, said single geometry generating resonant acoustic compression waves at an energy delivered during each half-cycle less than other members of said family of lamps.

7. A method as in claim 6 wherein said lamp is substantially spherical.

* * * * *